United States Patent [19]

Pandell

[11] Patent Number: 4,590,715

[45] Date of Patent: May 27, 1986

[54] TARPAULIN EDGE-FINISHED FOR SINGLE LINE TIE-DOWN

[75] Inventor: Nestor W. Pandell, Schenectady, N.Y.

[73] Assignee: Weathermate Marine Manufacturing, Inc., Salem, Mass.

[21] Appl. No.: 664,910

[22] Filed: Oct. 26, 1984

[51] Int. Cl.[4] ..... B32B 3/04; B32B 3/06

[52] U.S. Cl. ..... 52/3; 428/83; 428/123; 428/126; 428/127; 428/128; 428/129; 428/137; 428/192; 428/193

[58] Field of Search ..... 428/83, 123, 124, 126, 428/127, 128, 129, 131, 137, 192, 193; 52/3, 4

[56] References Cited

U.S. PATENT DOCUMENTS

| | | | |
|---|---|---|---|
| 2,705,210 | 3/1955 | Boecker | 428/123 |
| 3,024,796 | 3/1962 | Bird . | |
| 3,084,460 | 4/1963 | Huberman | 428/123 X |
| 3,354,472 | 11/1967 | Steinbeck . | |
| 3,520,004 | 7/1970 | Patnaude . | |
| 3,683,427 | 8/1972 | Burkholz et al. . | |
| 3,766,573 | 10/1973 | Burkholz et al. . | |
| 4,402,305 | 9/1983 | Kremen . | |

*Primary Examiner*—Alexander S. Thomas
*Attorney, Agent, or Firm*—Nolte, Nolte and Hunter

[57] ABSTRACT

A tarpaulin or other similar protective cover of flexible sheet material is adapted to be tied down securely with the aid of a single tie-down line extending around its periphery. The periphery is edge-finished with a continuous hollow conduit laterally fluted at equally spaced intervals with identical semi-circular cut-outs deep into the hollow conduit. Each cut-out defines a hole in the conduit wall which, in use of the tarpaulin with a tie-down line loosely contained in, and longer than, the conduit, permits a length portion of the line to be pulled outwardly from the conduit in a looped configuration for anchoring attachment to a respective tie-down device. Tearing of the tarpaulin by anchoring forces exerted thereon by way of the single tie-down line is effectively resisted, notwithstanding the absence of grommets or other relatively expensive reinforcement measures.

3 Claims, 8 Drawing Figures

TARPAULIN EDGE-FINISHED FOR SINGLE LINE TIE-DOWN

BACKGROUND OF THE INVENTION

This invention relates to edge finished sheets, such as a tarpaulins, which in use are tied down to form secure coverings or enclosures.

Sheets, adapted to be tied down so that they can serve as coverings or enclosures, are well known. For example, U.S. Pat. Nos. 3,354,472, 3,520,004, 3,683,427 and 3,766,573 disclose sheets which can be used as pool covers, and U.S. Pat. No. 3,024,796 discloses a sheet which can form an air-inflated enclosure. Each of these sheets has been adapted to be securely tied down about all or most of its periphery to cover or enclose a space beneath the sheet. However, the periphery of each of these sheets has been inevitably subjected to forces which have tended to tear the edges of the sheet unless the sheet has been specially reinforced, for example, by providing grommets where the sheet has been tied down along its edges.

As a result, ways have been sought for making the edges of a sheet, to be used as a covering or enclosure, more resistant to tearing without the need for special reinforcement.

SUMMARY OF THE INVENTION

In accordance with this invention, a method is provided a tarpaulin or other similar protective cover of flexible sheet material, wherein the periphery of the tarpaulin is uniformly edge-finished with a continuous hollow conduit, said edge-finished periphery being laterally fluted at equally spaced intervals with identical semi-circular cut-outs deep into said hollow conduit, each cut-out defining a hole in the conduit wall which, in use of the tarpaulin with a tie-down line loosely contained in, and longer than, the conduit, permits a length portion of the line to be pulled outwardly from the conduit in a looped configuration for anchoring attachment to a respective tie-down device, said equally spaced intervals substantially exceeding the diameters of said holes.

The continuous hollow conduit, with which the periphery of the tarpaulin is uniformly edge-finished, may be incorporated either in a frill made integral with the tarpaulin or in a hem of the tarpaulin.

Preferably, a tie-down line longer than the conduit is already loosely contained therein as part of the tarpaulin structure and cooperates with the holes in the conduit wall in the manner, and for the purpose, stated above.

BRIEF DESCRIPTION OF THE DRAWINGS

FIG. 1 shows the top surface of the sheet and shows a plurality of holes provided along the edges on three sides of the sheet.

FIG. 5 shows the top surface of the rectangular edge finishing sheet and shows a plurality of holes extending between two opposite edges of the sheet.

DETAILED DESCRIPTION OF THE PREFERRED EMBODIMENTS

Figure 1:
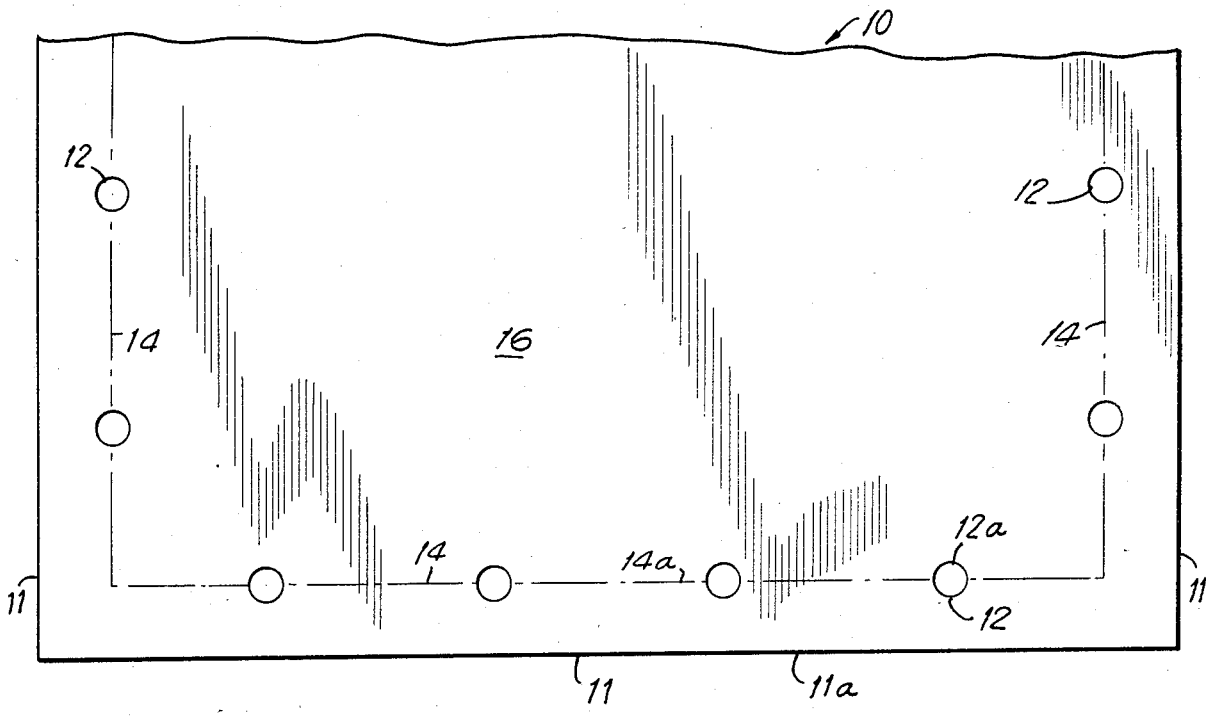
FIG. 1 is a schematic top plan view of a portion of a rectangular sheet which can be edge finished by a method for producing an embodiment of this invention.

Shown in FIG. 1 is a portion of a rectangular sheet, generally 10. Sheet 10 can be a fabric that is woven, braided, knitted or the like from a natural or synthetic fiber which can be single coated, double coated, center coated or uncoated by a binding material such as a plastic or adhesive coating. Sheet 10 can also be a non-woven fabric or a solid plastic film or sheet. Located in a row along the edge 11 on each side of the sheet 10 are a plurality of round holes 12 that are spaced away from the adjacent edge 11. The center of each hole 12 is spaced substantially the same distance away from its adjacent edge 11, and the center of each hole lies along a fold line 14 parallel to its adjacent edge 11. In accordance with this invention, each edge 11 and its parallel fold line 14 extend continuously along substantially the entire length of one of the four sides of the rectangular sheet 10, without interruption. For example, edge 11*a* extends continuously along substantially the entire length of the bottom side of sheet 10 as shown in FIG. 1. Likewise, the fold line 14*a*, that is parallel to edge 11*a* and extends through the center of the four holes 12*a* along edge 11*a*, extends along the entire length of the bottom side of sheet 10 as shown in FIG. 1.

Figure 2:
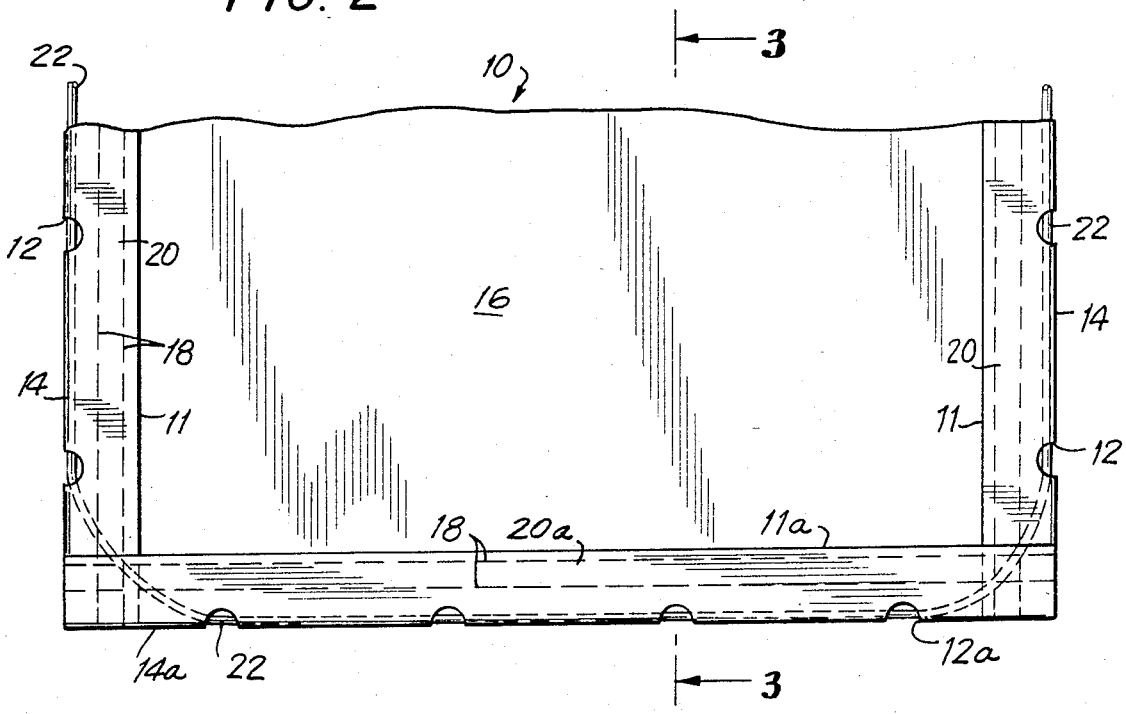
FIG. 2 is a schematic top plan view of the sheet of FIG. 1 after it has been edge finished on three sides by the method.
Figure 3:
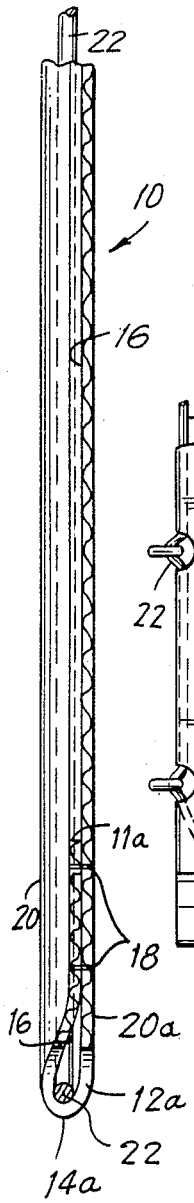
FIG. 3 is a sectional view taken along line 3—3 in FIG. 2 of the edge finished sheet of FIG. 2.

Shown in FIGS. 2 and 3 is the rectangular sheet 10 as edge finished. The sheet 10 has been folded about each fold line 14, so that each edge 11 of the sheet 10 lies atop the sheet and inwardly of one of the fold lines 14 and portions of the top surface 16 of the sheet 10 face each other. The facing portions of the top surface 16 of the sheet 10 have then been sewn together by means of a plurality of conventional stitches 18 to secure such surface portions to one another, thereby forming a hem. Preferably, the stitches 18 are located between each edge 11 and its adjacent holes 12 in the sheet 10. The resulting sewn portions of the sheet 10 form a tube 20 along each side of the sheet 10, as edge finished, and each tube 20 constitutes a hollow conduit which extends continuously along substantially the entire length of one of the fold lines 14 of the sheet 10. For example, tube 20*a* extends continuously along substantially the entire length of fold line 14*a* on the bottom side of sheet 10, as edge finished.

As also shown in FIGS. 2 and 3, the sheet 10, as edge finished, has a tie-down line 22 loosely contained within each tube 20, extending in the direction of the fold line 14 of the tube. Preferably, a single tie-down line 22 is provided about the entire periphery of the edge finished sheet 10, and the tie-down line 22 extends through all of the tubes 20 on the sides of the edge finished sheet. The tie-down line 22 can be made from conventional natural or synthetic fibers such as braided or twisted nylon, manila, polyester or polypropylene fibers. The tie-down line 22 can also be a metal wire or cable. The tie-down line 22 is preferably provided between the facing portions of the top surface 16 of the sheet 10, as folded, before securing the facing surface portions of the folded sheet 10 together. Thereby, the tie-down line 22 is within each tube 20, as formed, and need not be inserted through the holes 12 after forming each tube 20.

Figure 4:
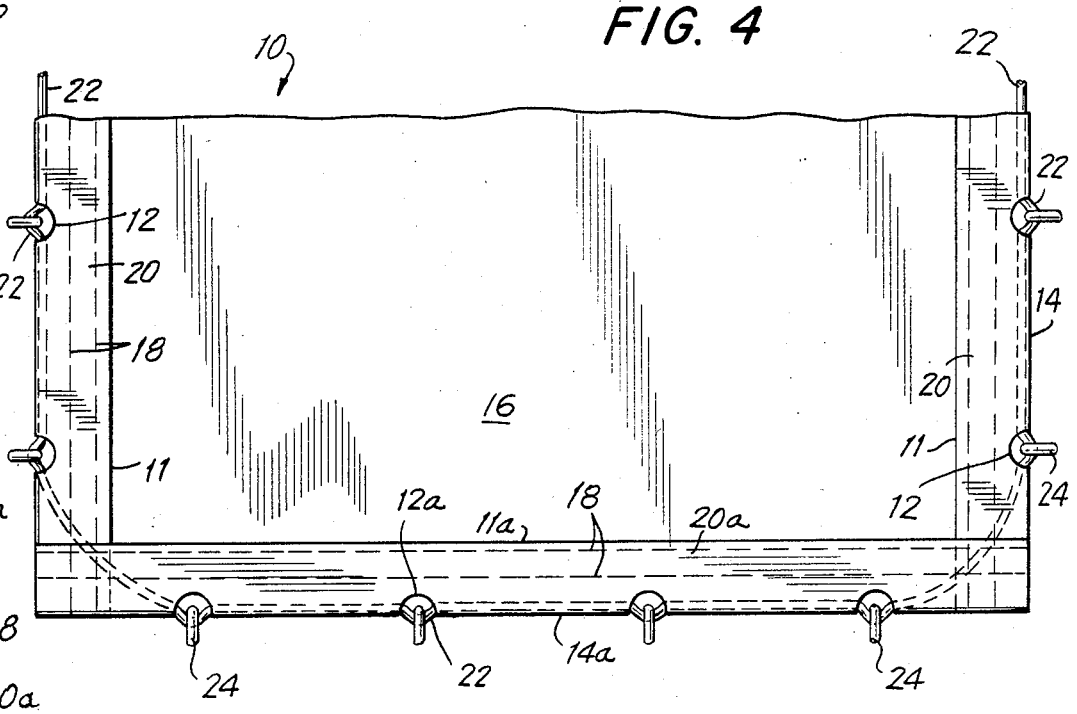
FIG. 4 shows schematically one method of tying down the periphery of the sheet of FIG. 2.

The tie-down line 22 can be used in a conventional manner to tie down the periphery of the sheet 10, as edge finished. In this regard, length portions of the tie-down line 22 can be pulled outwardly of each tube 20 through each hole 12 in a looped configuration and be attached to any suitable tie-down device 24 as schematically shown in FIG. 4. By means of the tie-down device 24 attached to the tie-down line 22 through each hole 12, the edge finished sheet 10 can be used to provide a secure covering, e.g., for a pool. The edge finish of the sheet 10, reduces the likelihood that the edges of the sheet 10 will tear when stressed by relatively heavy loadings applied by a plurality of tie-down devices 24 attached to the tie-down line 22 and bearing on the edges of the holes 12, particularly in the area of the fold lines 14.

Figure 5:
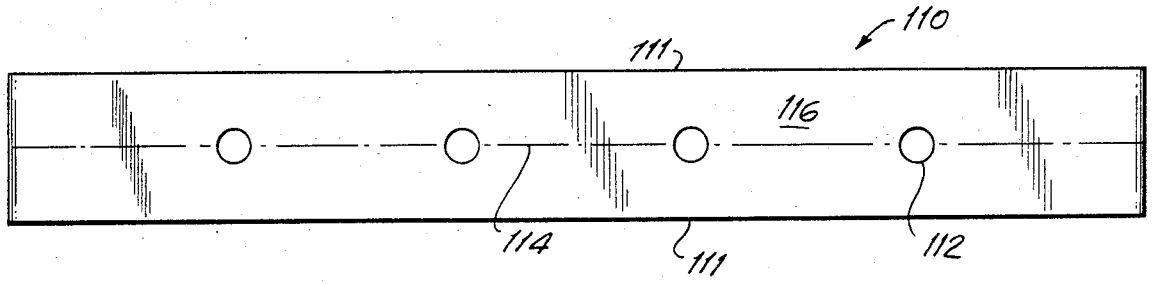
FIG. 5 is a schematic top plan view of a rectangular sheet which can be used in an alternative method for edge finishing a larger sheet.
Figure 6:
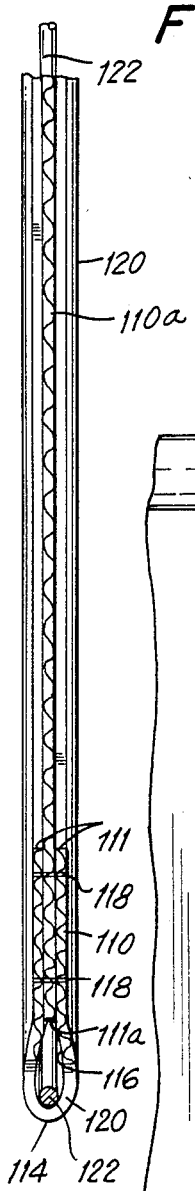
FIG. 6 is a sectional view, similar to FIG. 3, of a larger rectangular sheet that has been edge finished with the sheet of FIG. 5.

FIG. 5 shows a rectangular sheet 110 which can be used as a frill for edge finishing one side of a larger sheet, e.g., a larger rectangular sheet 110*a* as shown in FIG. 6. The sheets 110 and 110*a* can be made of the same materials as the rectangular sheet 10 of FIG. 1, and the sheets 110 and 110*a* can be made of the same or different materials from each other. The edge finishing sheet 110 has a pair of parallel edges 111 with the same length as the one side of the larger sheet 110*a* that is to be edge finished. A plurality of round holes 112 are provided in a row between the parallel edges 111 of the edge finishing sheet 110. The holes 112 are spaced away from each edge 111. The center of each hole 112 is substantially the same distance from one of the edges 111 and is located along a fold line 114 that is parallel to the one edge 111. Preferably, the center of each hole 112 along the fold line 114 is midway between the two edges 111.

The edge finishing sheet 110 can be used for edge finishing one of the four sides of the larger rectangular sheet 110*a*. In this regard, the edge finishing sheet 110 can be folded about its fold line 114 so that portions of the top surface 116 of the edge finishing sheet 110 face each other. Then, an edge 111*a* on the one side of the larger sheet 110*a* can be inserted between the facing portions of the top surface 116 of the edge finishing sheet 110 so that the edge 111*a* of the larger sheet 110*a* is located between the parallel edges 111 and the fold line 114 of the edge finishing sheet 110 and extends in the direction of the fold line 114. The facing portions of the top surface 116 of the edge finishing sheet 110 can then be secured to each other and to the larger sheet 110*a*, preferably by means of stitches 118 between the holes 112 and the edges 111, to form a tube 120 extending continuously along the one side of the edge finished, larger sheet 110*a* as shown in FIG. 6 and extending continuously along the entire length of the fold line 114.

In edge finishing the larger sheet 110*a* with the edge finishing sheet 110, a tie-down line 122, extending in the direction of the fold line 114 of the edge finishing sheet 110, is preferably provided as shown in FIG. 6 between the facing portions of the top surface 116 of the sheet 110 and between the parallel edges 111 and the fold line 114 of the sheet 110 before securing the facing portions of the top surface 116 of the edge finishing sheet 110 to each other and to the larger sheet 110*a* with the stitches 118. Thereby, the tie-down line 122 is located within the tube 120, as formed. Alternatively, the tie-down line 122 can be inserted in a conventional manner into the holes 112 of the tube 120 after the tube is formed on the larger sheet 110*a*.

Figure 7:
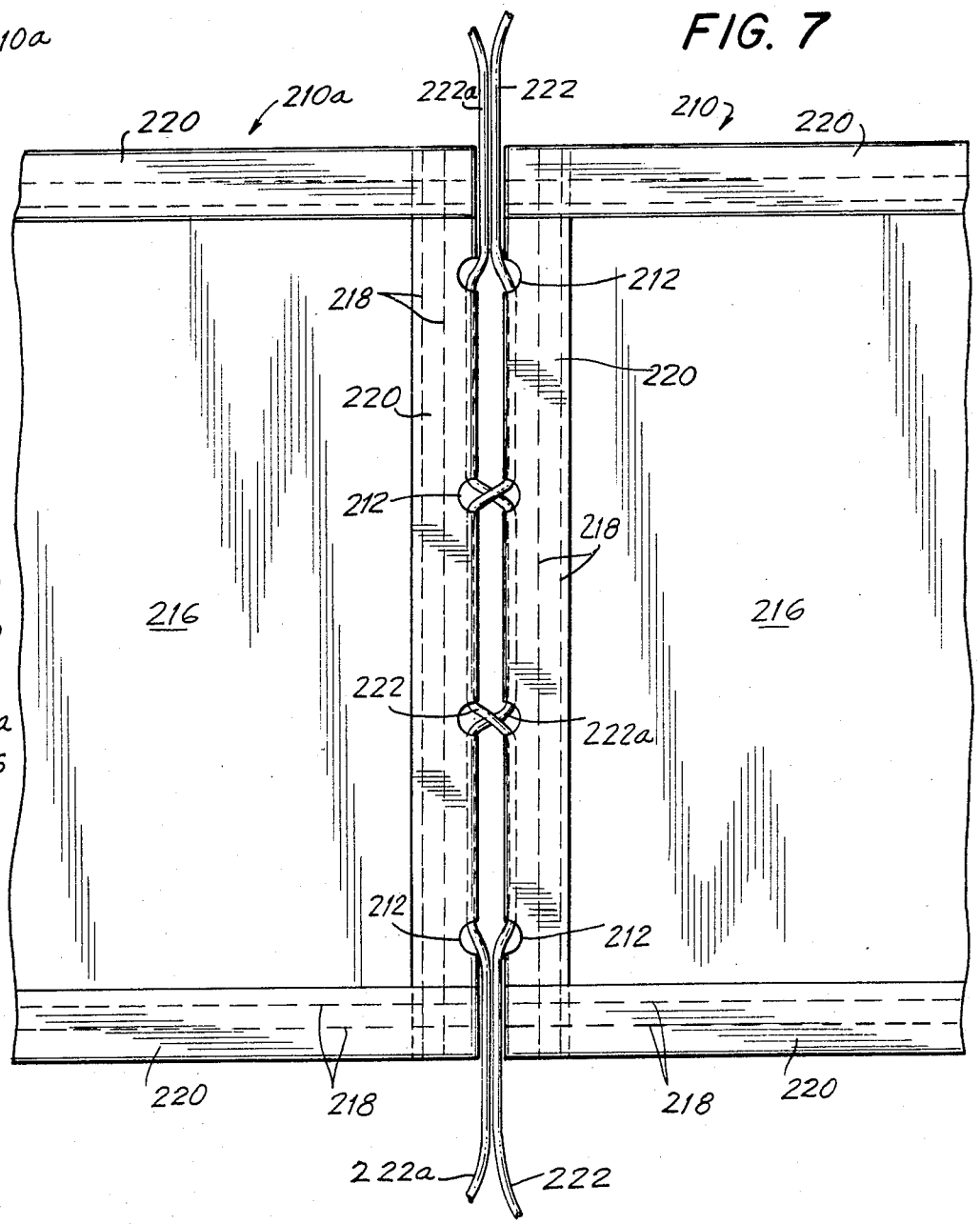
FIG. 7 shows schematically one method of tying together portions of two edge finished sheets, each of which embodies this invention.

FIG. 7 schematically shows a method for tying together two rectangular sheets 210 and 210*a* that have been edge finished in accordance with this invention. Each of the edge finished sheets 210 and 210*a* can be an edge finished sheet 10 of FIGS. 2 and 3 or an edge finished, larger sheet 110*a* of FIG. 6. Two tie-down lines 222 and 222*a* are interlaced through holes 212 in tubes 220 along one side of each of the sheets 210 and 210*a* after the sheets have been edge finished using stitches 218.

Figure 8:
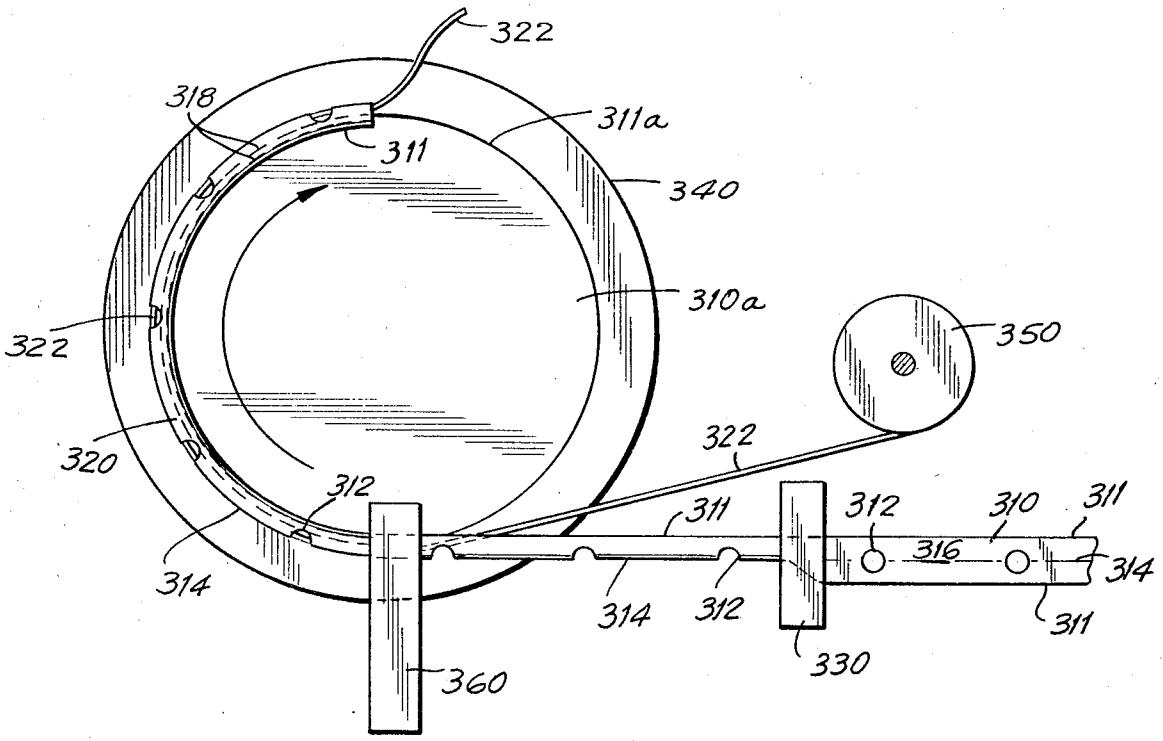
FIG. 8 is a schematic top plan view of means for carrying out another alternative method and shows a circular sheet being edge finished with a continuous length of a rectangular sheet like the sheet of FIG. 5.

FIG. 8 schematically shows a larger circular sheet 310*a* being edge finished, using a continuous length of a rectangular edge finishing sheet 310. Like the edge finishing sheet 110 of FIG. 5, the edge finishing sheet 310 of FIG. 8 has a pair of parallel edges 311 and a row of round holes 312 between the edges. The holes 312 are spaced away from each edge 311 of the edge finishing sheet 310, and the center of each hole 312 is located along a fold line 314 that is parallel to, and preferably midway between, the edges 311. The sheets 310 and 310*a* can be made of the same materials as the rectangular sheet 10 of FIG. 1, and the sheets 310 and 310*a* can be made of the same or different materials from each other. The edge finishing sheet 310 can be in the form of a roll (not shown) that is unwound when edge finishing the larger circular sheet 310*a* and is subsequently cut to the desired length.

As shown in FIG. 8, the edge finishing sheet 310 is folded about its fold line 314 so that portions of the top surface 316 of the edge finishing sheet 310 face each other. Such folding of the edge finishing sheet 310 can be continuously carried out by means of a conventional fabric folding device, generally 330. Then, the edge 311*a* of the larger circular sheet 310*a* is inserted between the facing portions of the top surface 316 of the edge finishing sheet 310 so that the edge 311*a* of the circular sheet 310*a* is located between the parallel edges 311 and the fold line 314 of the edge finishing sheet 310. This step can be carried out by providing the circular sheet 310*a* on a conventional circular turntable 340 and rotating the turntable 340 and circular sheet 310*a* while moving the upper and lower, facing portions of the edge finishing sheet 310 respectively above and below the moving edge 311*a* of the circular sheet 310*a*, preferably so that the fold line 314 of the edge finishing sheet 310 is substantially tangential to the edge 311*a* of the circular sheet 310*a*. A tie-down line 322 is preferably provided between the facing portions of the top surface 316 of the edge finishing sheet 310 and between the parallel edges 311 and the fold line 314 of the sheet 310 when the edge 311*a* of the circular sheet 310*a* is inserted between the facing portions of the edge finishing sheet 310. This step can be carried out by unwinding the tie-down line 322 from a spool 350 and moving the tie-down line 322 between the moving edge 311*a* of the circular sheet 310*a* on the rotating turntable 340 and the moving fold line 314 of the edge finishing sheet 310, preferably so that the tie-down line 322 is substantially tangential to the edge 311*a* of the circular sheet 310*a*.

Then, the facing portions of the top surface 316 of the edge finishing sheet 310 are stitched to each other and to the larger circular sheet 310*a* by a sewing machine 360 to form a tube 320 about the circular sheet 310*a* as shown in FIG. 8. Preferably, the sewing machine 360 provides a double row of stitches 318 between the edges 311 and the holes 312 in the edge finishing sheet 310. One row of stitches is preferably located adjacent to the holes 312, and the other row of stitches is preferably located adjacent to the edges 311 of the edge finishing sheet 310. The double row of stitches 318 serves to secure the edge finishing sheet 310 to the larger circular sheet 310*a*, with the tie-down line 322 within the tube 320, as formed, and with the tie-down line 322 readily accessible through each hole 312 in the tube 320.

It is considered that the invention and many of its attendant advantages will be understood from the foregoing description and that it will be apparent that various changes can be made in the steps of the described method for edge finishing a sheet without departing from the spirit and scope of the invention or sacrificing all of its material advantages, the methods hereinbefore described being merely preferred. In this regard, the holes 12, 12*a*, 112, 212 and 312 in sheets 10, 110, 210, 210*a* and 310 are preferably round before the sheets are folded, but the holes can have other shapes such as elliptical or rectangular. The tubes 20, 20*a*, 120, 220 and 320 are preferably formed by sewing the facing portions of the top surfaces 16, 116, 216 and 316 of the sheets 10, 110, 210, 210*a* and 310 to each other but can be formed by other means of securing the facing surface portions of such sheets to each other such as by adhesively bonding or heat sealing the sheets to each other. The sheets 10, 110*a*, 210, 210*a* and 310*a*, to be edge finished, can be triangular, hexagonal, octagonal, etc. or can be oval or the like and need not be rectangular or round.

I claim:

1. A tarpaulin or other similar protective cover of flexible sheet material, wherein the periphery of the tarpaulin is uniformly edge-finished with a continuous hollow conduit, said edge-finished periphery being laterally fluted at equally spaced intervals with identical semi-circular cut-outs deep into said hollow conduit, each cut-out defining in the conduit wall a hole whose diameter is substantially exceeded by each of said equally spaced intervals; and wherein means for anchoring said tarpaulin to external tie-down devices are provided at the periphery of said tarpaulin, said means comprising a tie-down line loosely contained, and freely movable, within said continuous hollow circuit, said tie-down line having a length sufficiently exceeding that of said conduit to permit concomitant withdrawal from said conduit through said holes of respective length portions of said tie-down line in looped configurations for anchoring attachment to respective ones of said external tie-down devices.

2. A tarpaulin or other similar protective cover of flexible sheet material according to claim 1, wherein said continuous hollow conduit, with which the periphery of the tarpaulin is uniformly edge-finished, is incorporated in a frill made integral with said tarpaulin.

3. A tarpaulin or other similar protective cover of flexible sheet material according to claim 1, wherein said continuous hollow conduit, with which the periphery of the tarpaulin is uniformly edge-finished, is incorporated in a hem of said tarpaulin.

* * * * *